United States Patent [19]

Korger

[11] 4,061,355

[45] Dec. 6, 1977

[54] SKI BRAKE

[75] Inventor: Heinz Korger, Munich, Germany

[73] Assignee: Hannes Marker, Garmisch-Partenkirchen, Germany

[21] Appl. No.: 696,716

[22] Filed: June 16, 1976

[30] Foreign Application Priority Data

June 16, 1975 Germany ..... 2526909

[51] Int. Cl.[2] ..... A63C 7/10

[52] U.S. Cl. ..... 280/605

[58] Field of Search ..... 280/605

[56] References Cited

U.S. PATENT DOCUMENTS

| | | | |
|---|---|---|---|
| 3,899,185 | 8/1975 | Martin | 280/605 |
| 3,940,158 | 2/1976 | Wearli | 280/605 |
| 3,989,271 | 11/1976 | Riedel | 280/11.37 A X |

FOREIGN PATENT DOCUMENTS

| | | | |
|---|---|---|---|
| 2,531,466 | 2/1976 | Germany | 280/605 |

*Primary Examiner*—Joseph F. Peters, Jr.
*Assistant Examiner*—David M. Mitchell
*Attorney, Agent, or Firm*—Fleit & Jacobson

[57] ABSTRACT

In a ski brake comprising a pedal for pivotally mounting on a ski and two brake prongs for projecting downwardly from the ski at opposite sides thereof, the pedal is formed from spring wire shaped to define two coplanar open loops. The adjacent ends of the loops are interconnected to form a junction which is spaced from the pivotal axis of the pedal. The junction is linked to a coupling member which extends beyond the pivotal axis and is there hinged at a point that is fixed with respect to the ski.

7 Claims, 4 Drawing Figures

SKI BRAKE

The invention relates to ski brakes in the form of a two-armed lever having a pivot which extends along the ski surface transversely to the length of the ski and one arm of which serves as a pedal for actuation by the ski boot whilst the other arm is bifurcated and forms two brake prongs on the outside of the ski, the pedal arm being so spring-loaded that, when the boot is removed, the brake automatically assumes its braking position in which the prongs project downwardly beneath the ski.

In known such ski brakes, spring-loading is effected by at least one coiled bending spring which is placed over a pin forming the pivotal axis and has one limb acting on the pedal.

From certain paper proposals describing so called climbing aids or anti-slip-back devices, it is also known to load a brake lever by means of a helical tension or compression spring or by means of a leaf spring.

A disadvantage that is common to all ski brakes resides in the large structural height and in the constructional expense. The large structural height makes it difficult or even impossible to provide the ski brake in conjunction with modern safety ski bindings whilst the constructional expense has an unfavourable effect on the manufacturing costs. In addition, there is a functional defect in so far that the spring stress is greatest in the inoperative position of the brake so as to exert the largest possible force when swinging the brake to its operative position. This is undesirable because the force acts on the ski boot during skiing and thus has a detrimental effect on the safety function of the ski binding by falsifying the releasing values for which the binding has been preset.

This functional defect is also present in another known ski brake in which only one brake prong is provided on one side of the ski and the two-armed lever is formed from a single round spring wire. By appropriately shaping the spring wire and mounting it on the surface of the ski, no additional spring is required. However, it is a disadvantage of this brake that it has only one brake prong. In practice, one attempts to obtain an adequate braking effect by mounting two such ski brakes on one and the same ski. This, of course, to a large extent nullifies the advantage of simplicity and economy compared with the other known brakes.

The present invention therefore aims to provide a ski brake that can be made simply and cheaply, has small dimensions but nevertheless achieves the desired braking effect.

According to the invention, a ski brake is provided in the form of a two-armed lever having a pivot which extends along the ski surface transversely to the length of the ski and one arm of which serves as a pedal for actuation by the ski boot whilst the other arm is bifurcated and forms two brake prongs on the outside of the ski, the pedal arm being so spring-loded that, when the boot is removed, the brake automatically assumes its braking position in which the prongs project downwardly beneath the ski, wherein said pedal comprises a substantially M-shaped spring wire frame of which the outer ends extend at least up to the region of the pivot and the central portion is spaced from the pivot and linked to a coupling member which is hinged to a fixed point beyond the pivot.

The geometry of the ski brake is so seleced that the brake prongs are held at an acute angle to the skiing surface of the ski by relaxation of the spring wire frame in the braking position, the preferred angle being about 70°. Since the brake prongs and the pedal practically include an angle of 180°, the pedal projects obliquely upwardly in the braking position. Upon introduction of the ski boot in the binding, the pedal is depressed and the two outer ends of the frame are stressed towards one another in bending because the coupling member holds back the central portion of the frame. This resilient deformation occurs most extensively in the inoperative position of the brake. In contrast with known ski brakes, the force that is stored thereby is not, however, applied fully to the sole of the boot in this inoperative position of the brake.

One requirement of a ski brake that has hitherto not been fulfilled or only inadequately met is an increase in the resilient resistance upon loading of the brake beyond its normal braking position. This is readily possible with the ski brake according to the invention. When the brake is loaded in this manner, the central portion of the spring wire frame is held back by the coupling member so that the frame is stressed in torsion on both sides of the central portion. When the deflecting force falls off, the brake automatically returns to its normal braking position.

The outer ends of the spring wire frame may have a flanged extension, the extensions being coaxial and forming the pivot of the lever. The outer ends of the spring wire frame are preferably drawn in and its extensions are flanged outwardly.

In a preferred embodiment, the outer ends of the spring wire frame extend beyond the pivot and form or carry the brake prongs. In this case the outer ends of the spring wire frame may be drawn in near the pivot and the portions of this drawn-in part adjacent the brake prongs are coaxial and form the pivot of the lever.

If the pivot is in two parts, they may be held apart on the ski, have limited longitudinal movement and be resiliently loaded towards one another. This results in a further advantage compared with known ski brakes, namely that the brake or its prongs are automatically set or automatically adjust themselves to the width of the ski. This is very important because the brake prongs should be disposed as close as possible to the sides of the ski. In as far as known ski brakes permit any kind of adaptation to the width of the ski, this is achieved by displacing components which must be set in the adjusted position by means of screws, this making assembly of the brake complicated and cumbersome.

An example of the invention is illustrated in the accompanying drawings, wherein.

Figure 2:
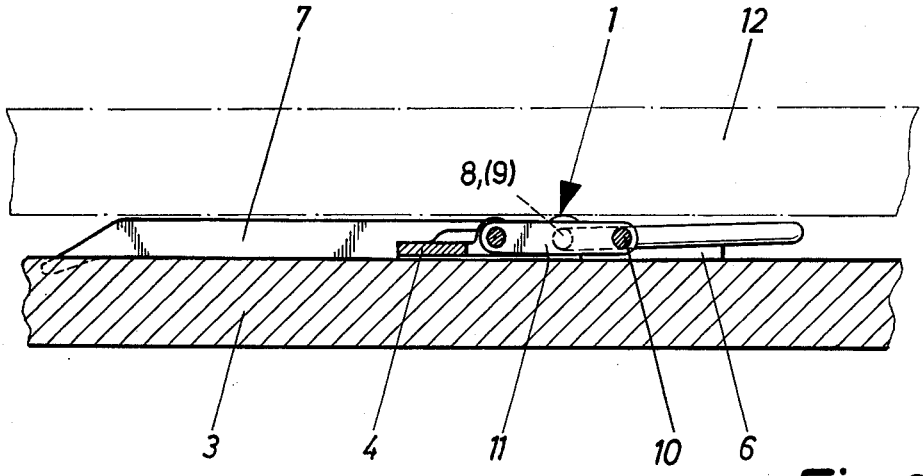
FIG. 2 is a section on the line II—II of FIG. 1.
Figure 1:
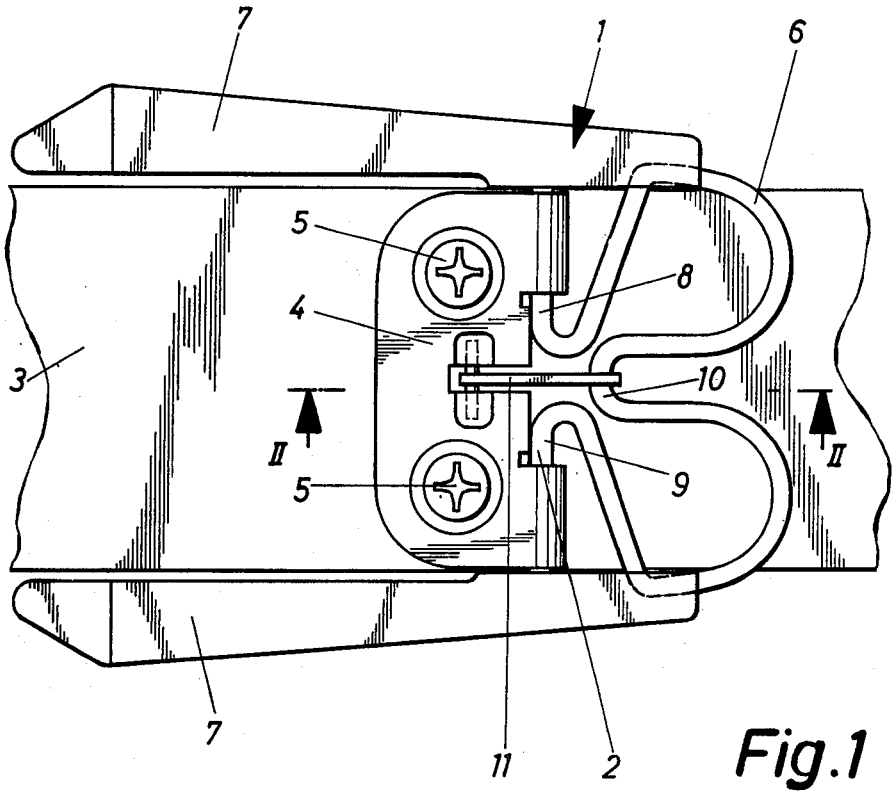
FIG. 1 is a plan view of the brake in its inoperative position.

The illustrated ski brake 1 acts as a two-armed lever of which the pivot 2 is held to the surface of a ski 3 by means of a bearing member 4. The bearing member is screwed to the ski by means of two screws 5 and has a width corresponding to the smallest width of conventional skis. The lever arm 6 disposed on the right-hand side of the pivot 2 as viewed in FIGS. 1 and 2 serves as a pedal whilst the other lever arm is divided and forms two brake prongs 7 disposed outside the ski.

The pedal is formed from a substantially M-shaped bent spring wire frame. In the illustrated example, the outer ends of the spring wire frame extend beyong the pivot 2 and form a support (not shown) for a plastics covering that forms the associated brake prong 7. In relation to the M shape of the spring wire frame, the outer ends are drawn in in the vicinity of the pivot 2 so that the portions 8, 9 of this drawn-in part adjacent the brake prongs 7 are coaxial and form the pivot 2 of the lever.

The required spring loading for automatically swinging the ski brake to its braking position is obtained by utilising the inherent resilience of the substantially M-shaped bent spring wire frame in so far that the central portion 10 of the frame that terminates at a spacing from the pivot 2 is linked to a coupling member 11 which is hinged to the bearing member 4 beyond the pivot 2.

Figure 3:
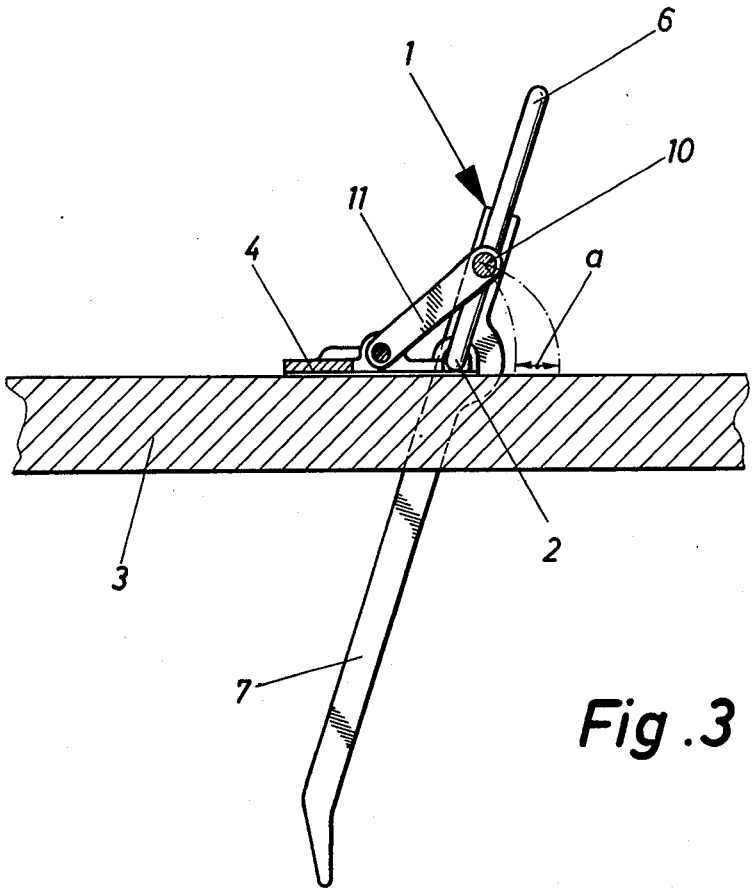
FIG. 3 is a section similar to FIG. 2 but showing the brake in its normal braking position.

FIG. 3 shows a ski brake in its normal braking position in which the spring wire frame is practically unstressed. The brake prongs 7 are held at an acute angle of about 70° to the skiing suface of the ski. This angle is predetermined by the length of the coupling member 11 and the spacing of the central M portion 10 from the pivot 2. When the brake 1 is swung from the FIG. 3 braking position to the inoperative position of FIG. 2, as will occur when a ski boot 12 (shown in chain-dotted lines in FIG. 2) is placed in the ski binding, the two outer portions of the M are pulled together because the central M portion 10 is not simply swung about the pivot 2 but is held back by the coupling member 11 by a distance a indicated in FIG. 3. Thus, when the pedal is depressed, the two outer M portions are loaded towards one another in bending. Their elastic deformation is a maximum in the inoperative position of the ski brake. However, what is important is that the stored force in the inoperative position is only to a small extent applied to the sole of the boot by reason of the substantially 180° position with respect to the cooupling member. Accordingly, the stored spring force does not detrimentally influence the safety function of the ski binding.

Figure 4:
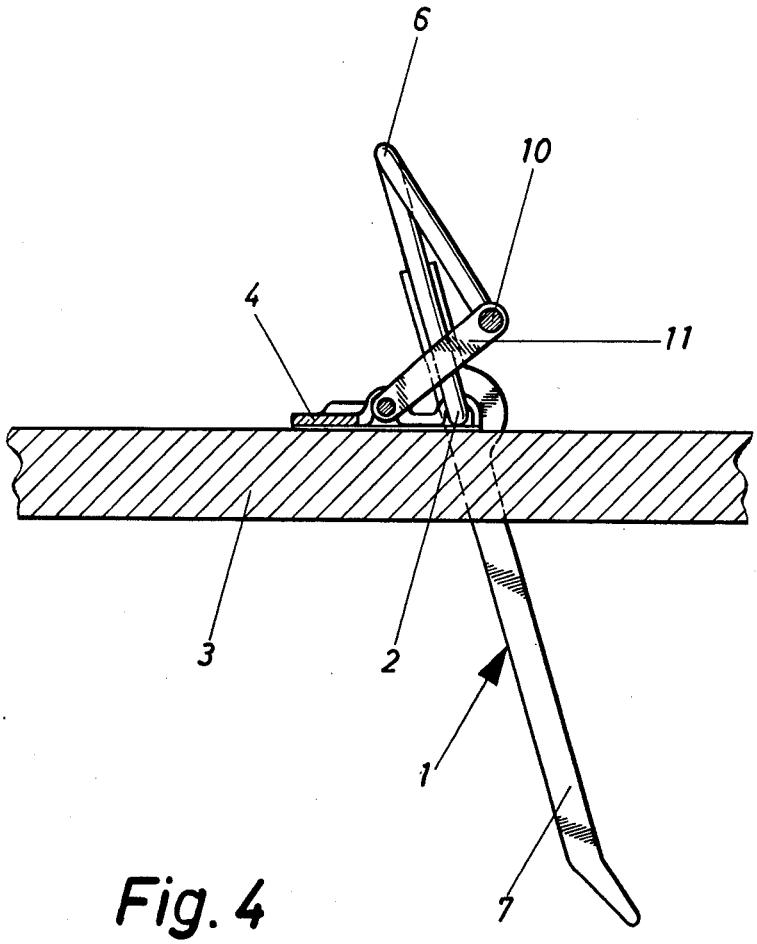
FIG. 4 is a view similar to FIG. 3 but showing the brake when loaded beyond its normal braking position.

One advantage of the ski brake 1 compared with known ski brakes resides in the fact that, as shown in FIG. 4, it can resiliently swing beyond its normal braking position when it is overloaded for example by the brake prongs 7 abutting against some obstacle. In this case the central portion 10 of the frame is held back by the coupling member 11 so that the parts of the frame to both sides of the central portion are torsionally stressed. When the deflecting force drops off, the brake automatically returns to its normal braking position of FIG. 3. By reason of this accurate determination of the braking position, it is practically impossible for application of the ski boot 12 to swing the ski brake in the opposite direction and thereby damage or destroy the brake and make it useless.

The brake is readily applicable to all widths of skis. No special setting operation is required. This is possible because the two pivot portions 8, 9 are spaced from one another on the ski, are axially displaceable to a limited extent and are resiliently loaded towards one another by the shaping of the spring wire frame.

Depending on the conditions set by the sole of the boot or the safety ski binding, the ski brake according to the invention can be nounted practically anywhere in the region covered by the boot. In the braking position, the prongs may be inclined towards the tip of the ski or towards the back end.

I claim:

1. In a ski brake adapted to be attached to a ski surface and having the form of a two-armed lever having a pivot which is adapted to extend along the ski surface transversely to the length of the ski and one arm of which serves as a pedal for actuation by a ski boot, whilst the other arm is bifurcated and forms two brake prongs on the outside of the ski, the pedal arm being so spring-loaded that, when the boot is removed, the brake automatically assumes its braking position in which the prongs project downwardly beneath the ski, the improvement comprising the pedal being formed in a substantially M-shape out of a spring wire frame and a coupling member hinged at one end to the central portion of the spring wire frame which lies spaced from the pivot on one side thereof, the other end of said coupling member adapted to be pivotally mounted to the ski on the side of the pivot remote from said central portion of the spring wire frame.

2. In a ski brake according to claim 1, the improvement further comprising the outer end portions of said spring wire frame having their ends futherest from said central portion forming bent extensions, the extensions being coaxial and forming said pivot.

3. In a ski brake according to claim 2, the improvement further comprising the outer end portions of said spring wire frame having their ends closest said central portion compressed, and said bent extensions being bent outwardly.

4. In a ski brake according to claim 1, the improvement further comprising the two outer end portions of said spring wire frame having their ends furtherest from said central portion of said spring wire frame adapted to extend beyond the edges of a ski holding the ski brake to form said two brake prongs.

5. In a ski brake according to claim 4, the improvement further comprising the two outer end portions of said spring wire frame having their ends closest said central portion of said spring wire frame compressed, portion of said two outer end portions between said closest ends and said furtherest ends being coaxial and forming said pivot.

6. In a ski brake according to claim 1, the improvement further comprising the pivot being formed in two parts which are adapted to be mounted in a spaced apart relationship on the ski, said two parts having limited movement in a direction parallel to the long axis of a ski holding the ski brake and being resiliently loaded towards one another.

7. A ski brake comprising a mounting adapted for attachment to a ski surface and having two bearing holes, a wire spring shaped to form two coplanar open loops defining a pedal, and two coaxial pivot pins received in said bearing holes of said mounting and having extensions which project beyond said mounting and the edges of a ski holding said mounting to form brake prongs, one end of each loop being integral with one of said pivot pins and the other ends of the loops being joined to form a junction on one side of the axis of said pivot pins and laterally displaced therefrom, a swing arm pivoted to one end of the junction with the other end of the swing arm being hingedly connected to said mounting at a point spaced from the axis of said pivot pins and on the opposite side thereof so that when said mounting is secured to the ski with said pivot pins extending transversely across the ski and the ski extending between said prongs, said pedal projects upwardly from the ski and said prongs project beneath the ski at an angle predetermined by the length of said swing arm and by said spacing of said junction from said pivot pins and, when a ski boot depresses said pedal, said wire spring becomes stressed swinging said prongs level with said ski.

* * * * *